US006492603B1

(12) United States Patent
Spedale et al.

(10) Patent No.: US 6,492,603 B1
(45) Date of Patent: Dec. 10, 2002

(54) POWER SWITCH MODULE

(75) Inventors: Joseph J. Spedale, Chicago, IL (US); Michael S. Pedersen, Des Plaines, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/929,305

(22) Filed: Aug. 14, 2001

(51) Int. Cl.[7] ..... H01H 9/00; H01H 1/58; H01H 21/24

(52) U.S. Cl. ..... 200/51.03; 200/284; 200/293; 200/339; 200/553

(58) Field of Search ..... 200/5 R, 5 A, 200/51 R–5.11, 553, 584, 293, 329, 339; 439/185, 395, 402, 404

(56) References Cited

U.S. PATENT DOCUMENTS

| | | | | |
|---|---|---|---|---|
| 3,209,091 | A | 9/1965 | Freathy et al. | 200/51 |
| 3,324,260 | A | 6/1967 | Schumacher | 200/51 |
| 3,493,916 | A | 2/1970 | Hansen | 339/17 |
| 3,670,121 | A | 6/1972 | Howe | 200/67 G |
| 3,671,693 | A | 6/1972 | Farrell | 200/67 G |
| 3,673,368 | A | 6/1972 | Howe et al. | 200/67 G |
| 3,749,872 | A | 7/1973 | Foster | 200/166 PC |
| 3,879,592 | A | 4/1975 | Comerford et al. | 200/153 G |
| 4,103,125 | A | 7/1978 | Marrero | 200/51 R |
| 4,272,662 | A | 6/1981 | Simpson | 200/275 |
| 4,383,155 | A | 5/1983 | Tenner | 200/315 |
| 4,410,230 | A | 10/1983 | San Miguel | 339/126 M |
| 4,447,689 | A | 5/1984 | Schilller | 200/330 |
| 4,525,253 | A | 6/1985 | Sorenson | 200/68.2 |
| 4,869,677 | A | 9/1989 | Johnson et al. | 439/80 |
| 4,982,061 | A | 1/1991 | Dignal | 200/302.3 |
| 5,171,161 | A | 12/1992 | Kachlic | 439/352 |
| 5,173,056 | A | 12/1992 | Kniese et al. | 439/79 |
| 5,199,886 | A | 4/1993 | Patterson | 439/79 |
| 5,236,375 | A | 8/1993 | Kachlic | 439/607 |
| 5,252,080 | A | 10/1993 | Pesson | 439/79 |
| 5,293,018 | A | 3/1994 | Lander | 200/557 |
| 5,364,280 | A | 11/1994 | Colleran | 439/76 |
| 5,366,381 | A | 11/1994 | Kile | 439/79 |
| 5,452,175 | A | 9/1995 | Tsai | 361/643 |
| 5,453,016 | A | 9/1995 | Clark et al. | 439/79 |
| 5,482,470 | A | 1/1996 | Atsumi et al. | 439/246 |
| 5,490,787 | A | 2/1996 | Bowman et al. | 439/79 |
| 5,507,659 | A | 4/1996 | Sumida et al. | 439/157 |
| 5,511,984 | A | 4/1996 | Olson et al. | 439/79 |
| 5,518,422 | A | 5/1996 | Zell et al. | 439/608 |
| 5,564,948 | A | 10/1996 | Harting et al. | 439/607 |
| 5,584,709 | A | 12/1996 | Kiat | 439/79 |
| 5,591,035 | A | 1/1997 | Burkholder et al. | 439/79 |
| 5,591,036 | A | 1/1997 | Doi et al. | 439/79 |
| 5,593,307 | A | 1/1997 | Bale et al. | 439/79 |
| 5,601,183 | A | 2/1997 | Boyd et al. | 200/553 |
| 5,616,035 | A | 4/1997 | Shu | 439/79 |
| 5,639,250 | A | 6/1997 | Neef et al. | 439/79 |
| 5,651,685 | A | 7/1997 | Brinkman et al. | 439/79 |
| 5,658,155 | A | 8/1997 | McFarlane et al. | 439/79 |
| 5,658,156 | A | 8/1997 | Henderson et al. | 439/79 |

(List continued on next page.)

*Primary Examiner*—Michael Friedhofer
(74) *Attorney, Agent, or Firm*—Paul F. Donovan; Mark W. Croll

(57) ABSTRACT

A combination power switch housing and electrical connector housing module wherein the power switch housing comprises an upper power switch housing section within which a rocker-type actuator is located along with common and make/break electrical contacts, and a lower power switch housing section integral with the upper power switch housing section and comprising a tubular section having a throughbore extending therethrough within which the electrical connector housing can be fixedly secured. The module also comprises resilient finger and lug structure for enabling mounting of the module upon a panel member.

22 Claims, 1 Drawing Sheet

U.S. PATENT DOCUMENTS

| | | | | |
|---|---|---|---|---|
| 5,659,209 | A | 8/1997 | Huen | 439/79 |
| 5,676,554 | A | 10/1997 | Tsuji | 439/79 |
| 5,679,009 | A | 10/1997 | Okumura et al. | 439/79 |
| 5,688,130 | A | 11/1997 | Huang | 439/79 |
| 5,692,912 | A | 12/1997 | Nelson et al. | 439/79 |
| 5,702,257 | A | 12/1997 | Millhimes | 439/79 |
| 5,743,765 | A | 4/1998 | Andrews et al. | 439/608 |
| 5,807,124 | A | 9/1998 | Bricaud et al. | 439/188 |
| 5,819,912 | A | 10/1998 | Hou | 200/51.02 |
| 5,857,870 | A | 1/1999 | Carter | 439/402 |
| 6,066,815 | A | 5/2000 | Spedale | 200/51.03 |

POWER SWITCH MODULE

CROSS-REFERENCE TO RELATED UNITED STATES PATENT

This patent application is related to U.S. Pat. No. 6,066,815 which issued on May 23, 2000 to Joseph J. Spedale.

FIELD OF THE INVENTION

The present invention relates generally to power switches and electrical connectors, and more particularly to a new and improved combination, integral, one-piece rocker type power switch and electrical connector module which is particularly adapted for use in connection with the mounting of the same upon a panel member.

BACKGROUND OF THE INVENTION

Rocker type switches, comprising, for example, a rocker element operatively connected to or associated with a substantially U-shaped contactor having a hairpin configuration, are well-known in the art and are exemplified by means of the rocker switches disclosed within U.S. Pat. No. 6,066,815 which issued to Spedale in May, 2000, U.S. Pat. No. 5,293,018 which issued to Lander in March, 1994, U.S. Pat. No. 4,982,061 which issued to Dignal in January, 1991, U.S. Pat. No. 4,272,662 which issued to Simpson in June, 1981, U.S. Pat. No. 3,879,592 which issued to Comerford et al. in April, 1975, U.S. Pat. No. 3,749,872 which issued to Foster in July, 1973, and U.S. Pat. No. 3,670,121 which issued to Howe in June, 1972. As is also well-known, it is desirable, in the art of fabricating electrical circuits, to operatively associate or connect a suitable switch mechanism to at least one electrical connector in order to control electrical power to various circuits operatively associated with or controlled by means of the electrical connector.

As disclosed within the aforenoted U.S. Pat. No. 6,066,815 which issued to Spedale in may, 2000, the separate manufacture or fabrication of the electrical power switches and electrical connectors as separate or discrete entities, elements, or devices, was noted as not being particularly economical or cost-efficient in view of the fact that the power switches and electrical connectors must initially be separately manufactured, then secondly, the switch and connector units have to be separately inventoried and distributed to suppliers and end users, and thirdly, when the switches and connectors are to be incorporated, for example, within electrical systems or components, the switches and connectors must be separately mounted upon respective supports or bases and then electrically connected together. All of these manufacturing and assembly operations are obviously labor-intensive and time-consuming. Accordingly, the electrical connector-power switch module disclosed within the aforenoted patent to Spedale comprised a combination electrical connector-power switch module wherein the rocker switch assembly and the electrical connector were integrally connected together into a one-piece integral electrical connector-power switch module. Such disclosed one-piece integral electrical connector-power switch modules, however, comprised particular structure which adapted such one-piece integral electrical connector-power switch modules for electrical connection to and mounting upon printed circuit boards. Electrical applications and systems, other than those operatively associated with printed circuit boards, such as, for example, panel-mounted electrical components, can also benefit from the aforenoted manufacturing, distribution, and assembly techniques if a new and improved one-piece integral electrical connector-power switch module can be developed so as to permit such modules to be mounted upon bases, foundations, panels, or the like other than printed circuit boards.

A need therefore exists in the art for a new and improved combination, one-piece integral electrical connector-power switch module wherein the manufacturing process or operation for such a module is substantially simplified relative to the manufacture of electrical connectors and power switches as separate components or elements, wherein the inventory and supply of such connector and switch modules or parts is likewise simplified and more cost-efficient, wherein the manufacture of electrical systems and networks employing such electrical connector and power switch components or elements is necessarily simplified and most cost-effective, and wherein such one-piece integral electrical connector-power switch modules can be particularly adapted for mounting upon bases, foundations, panels, or the like other than printed circuit boards.

OBJECTS OF THE INVENTION

Accordingly, it is an object of the present invention to provide a new and improved combination, one-piece, integral rocker-type power switch and electrical connector module which is especially adapted for use and mounting upon a panel or wall member in order to control electrical power to various electrical circuits operatively connected to the electrical connector.

Another object of the present invention is to provide a new and improved combination, one-piece, integral rocker-type power switch and electrical connector module which is especially adapted for use and mounting upon a panel or wall member in order to control electrical power to various electrical circuits operatively connected to the electrical connector and which overcomes the various manufacturing, inventory, distribution, and assembly drawbacks or disadvantages characteristic of conventional or PRIOR ART systems or networks employing separate electrical connector and power switch elements or components.

An additional object of the present invention is to provide a new and improved combination, one-piece, integral rocker-type power switch and electrical connector module which is especially adapted for use and mounting upon a panel or wall member in order to control electrical power to various electrical circuits operatively connected to the electrical connector and which overcomes the various manufacturing, inventory, distribution, and assembly drawbacks or disadvantages characteristic of conventional or PRIOR ART systems or networks employing separate electrical connector and power switch elements or components by enabling the relative simplification and cost-effective manufacture, inventory, supply, and distribution of such power switch and electrical connector components as a result of the fabrication of a one-piece, integral rocker-type power switch and electrical connector module.

SUMMARY OF THE INVENTION

The foregoing and other objectives are achieved in accordance with the teachings and principles of the present invention through the provision of a new and improved combination, one-piece, integral rocker-type power switch and electrical connector module which comprises a rocker-type power switch housing which has structure integrally formed thereon which readily permits the mounting of the same upon a wall or similar mounting panel or member. In addition, the lower end portion of the power switch housing is integrally provided with a tubular housing section within which an electrical connector housing is adapted to be inserted. The electrical connector housing is, in turn, provided with a grid-type array of tubular compartments within which electrical connector pins or contacts are adapted to be inserted and secured. The electrical connector housing is also adapted to be fixedly secured within the tubular housing section of the power switch housing once the electrical connector housing is inserted within such tubular housing section of the power switch housing, and accordingly, the fabrication of the combination, one-piece, integral rocker-type power switch and electrical connector module is completed.

As a result of the fabrication or manufacture of such a combination, one-piece, integral rocker-type power switch and electrical connector module, the need for separate manufacture, inventory, supply, and distribution of the particular electrical connectors and power switch components or elements is effectively eliminated, and such components or elements are now able to be manufactured as a single unit or entity in a relatively simplified and cost-effective manner. In addition, the inventory, supply, and distribution of such components or elements is likewise substantially simplified.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
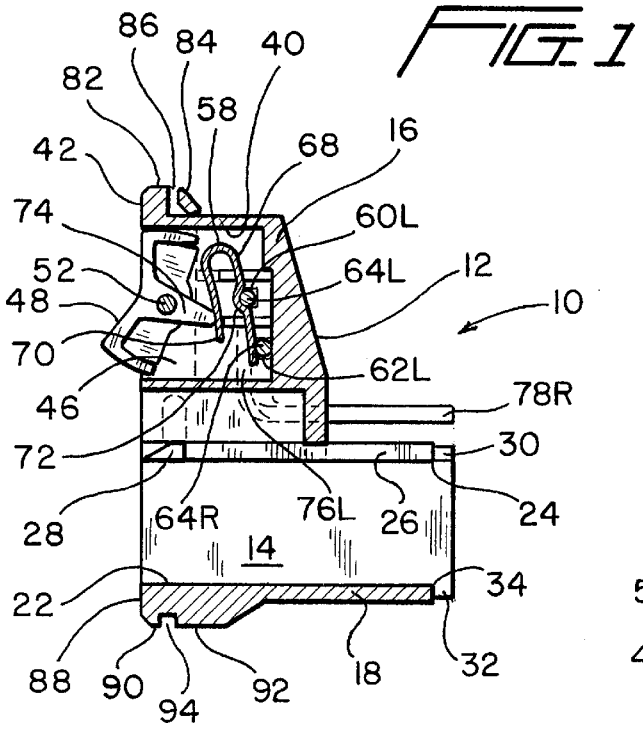
FIG. 1 is right-side, vertical cross-sectional view of a new and improved combination, one-piece, integral rocker-type power switch and electrical connector module constructed in accordance with the principles and teachings of the present invention and showing the cooperative parts thereof.
Figure 2:
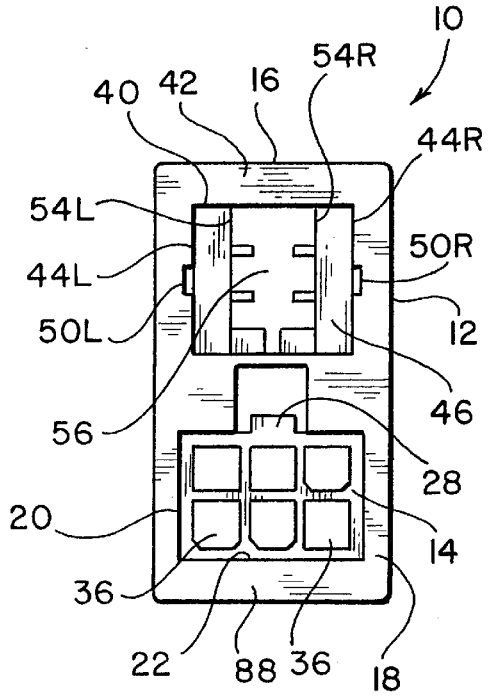
FIG. 2 is a front elevational view of the new and improved combination, one-piece, integral rocker-type power switch and electrical connector module as shown in FIG. 1, with the rocker actuator element removed.
Figure 3:
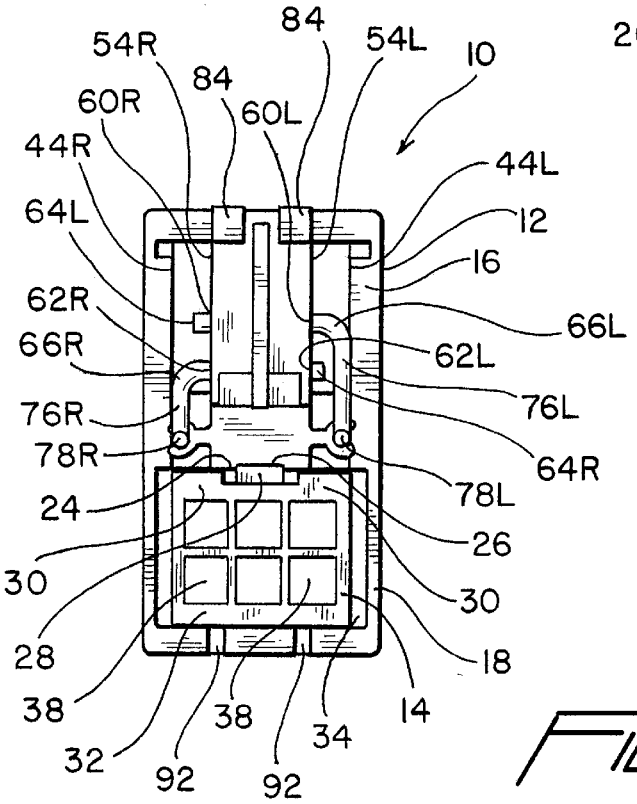
FIG. 3 is a rear elevational view of the new and improved combination, one-piece, integral rocker-type power switch and electrical connector module as shown in FIGS. 1 and 2.

Referring now to the drawings, and more particularly to FIGS. 1–3 thereof, a new and improved combination, one-piece, integral rocker-type power switch and electrical connector module, constructed in accordance with the principles and teachings of the present invention and showing the cooperative parts thereof, is disclosed and is generally indicated by the reference character 10. As can readily be appreciated, the new and improved combination, one-piece, integral rocker-type power switch and electrical connector module 10 is seen to comprise a power switch housing 12 and an electrical connector housing 14 which are adapted to be integrally bonded or secured together so as to form the new and improved combination, one-piece, integral rocker-type power switch and electrical connector module 10. More particularly, the power switch housing 12 is seen to comprise a substantially vertically oriented upper power switch housing section 16, and a horizontally oriented lower power switch housing section 18. The horizontally oriented lower power switch housing section 18 comprises a hollow tubular structure which in effect defines a bore 20 therethrough and within which the electrical connector housing 14 is adapted to be disposed and housed.

The bottom or lower interior surface portion 22 of the hollow tubular power switch housing section 18 forms one of a plurality of support walls or confining surfaces for the electrical connector housing 14, and a suitable adhesive may be applied to the lower surface portion 22 of the hollow tubular power switch housing section 18 in order to adhesively bond the electrical connector housing 14 within the hollow tubular housing section 18 of the power switch housing 12. Alternatively, in view of the fact that the power switch housing 12 and the electrical connector housing 14 are fabricated from a suitable thermoplastic material, the electrical connector housing 14 may be secured or affixed within the tubular power switch housing section 18 by means of ultrasonic welding, or the like. In order to in effect guide the insertion of the electrical connector housing 14 into the tubular bore 20 defined within the tubular housing section 18 of the power switch housing 12, the upper wall portion 24 of the tubular housing section 18 is provided with an axially extending recess or notch 26, and the upper surface wall portion of the electrical connector housing 14 is corresponding provided with an upstanding lug 28 for guided movement within the recess or notch 26 as the electrical connector housing 14 is inserted within the tubular bore 20 of the lower power switch housing section 18. In addition, the rear end face of the electrical connector housing 14 is provided with a pair of upper flange portions 30 for abutting the rear end face of the upper wall portion 24 of the tubular power switch housing section 18 when the electrical connector housing 14 is fully inserted within the tubular bore 20 of the tubular power switch housing section 18, and the rear end face of the electrical connector housing 14 is likewise provided with a lower flange portion 32 for abutting the rear end face of the lower wall portion 34 of the tubular power switch housing section 18 when the electrical connector housing 14 is fully inserted within the tubular bore 20 of the tubular power switch housing section 18. In this manner, it can be readily determined when the electrical connector housing 14 is in fact fully and properly seated within the tubular bore section 20 of the power switch housing 12.

As best seen from FIG. 2, the front section of the electrical connector housing 14 is provided with an array of substantially square-shaped apertures or cells 36 wherein the array of apertures or cells 36 comprises two rows of apertures or cells 36 with three apertures or cells 36 disposed within each row. In a similar manner, as can best be seen from FIG. 3, the rear section of the electrical connector housing 14 is provided with a corresponding 5 array of substantially square-shaped apertures or cells 38 wherein the array of apertures or cells 38 also comprises two rows of apertures or cells 38 with three apertures or cells 38 disposed within each row. The apertures or cells 36,38 are each adapted to receive suitable electrical connector terminals or pins, not shown, and suitable wall or detent structure, also not shown, is disposed within each cell or aperture at substantially axially central, interface portions of the cells 36,38 so as to mount the electrical connector terminals or pins, not shown, therein.

With reference again being made to FIGS. 1–3, the upper power switch housing section 16 is seen to comprise a recessed region 40 which extends internally into the upper power switch housing section 16 from a front face surface portion 42 thereof, and as best seen from FIG. 3, upper power switch housing section 16 further comprises a first set of laterally spaced side walls 44R,44L which serve to define a first internal chamber 46 therebetween within which a power switch rocker element 48 is pivotally disposed. Each one of the first set of laterally spaced side walls 44R,44L is provided with an aperture 50R,50L, and the power switch rocker element 48 is provided with a pair of laterally outwardly projecting trunnions 52, only one of which is shown in FIG. 1, which are adapted to be disposed within the apertures 50R,50L so as to pivotally mount the power switch rocker element 48 upon the power switch housing section 16. Upper switch housing 16 further comprises a second set of laterally spaced side walls 54R,54L between which there is defined a second internal chamber 56, and a substantially U-shaped or hair-pin type contactor 58 is adapted to be pivotally disposed within second internal chamber 56. Still yet further, it is also noted that each one of the laterally spaced side walls 54R,54L is provided with a pair of vertically and horizontally offset apertures 60R,60L and 62R,62L as best appreciated from FIGS. 1 and 3, whereby the sets of apertures 60R,60L and 62R,62L are coaxially aligned with respect to each other. In this manner, the sets of apertures 60R,60L and 62R,62L are able to house or accommodate first horizontally disposed terminal end contact portions 64R,64L of right and left wireform contact members 66R,66L.

With reference now being particularly made to FIG. 1, it is to be appreciated that the horizontally disposed terminal end contact portion 64R will serve as a make/break type contact within the power switch mechanism, while horizontally disposed terminal end contact portion 64L will serve as a common type contact within the power switch mechanism. It is further seen that the substantially U-shaped hairpin type contactor 58 is provided with a relatively long leg 68 and a relatively short leg 70, and a substantially concave or recessed portion 72 is defined within a substantially central portion of the long leg member 68 of the contactor 58. This substantially concave or recessed portion 72 is mounted upon the common type contact portion 64L so as to serve as a pivotal mounting for the substantially U-shaped hairpin type contactor 58 when the power switch rocker element 48 acts upon the shorter leg 70 of the contactor 58. More particularly, the power switch rocker element 48 comprises an actuator member 74 which is disposed in contact with the shorter leg 70 of the hairpin contactor 58, and when the rocker element 48 is disposed in the illustrated position, the terminal or free end portion of the longer leg 72 of the hairpin contactor 58 will be disposed in engagement with the make/break contact portion 64R whereby the switch mechanism is disposed in its ON state. To the contrary, when the rocker element 48 is moved to its opposite or alternative position, the hairpin contactor 58 will be accordingly pivoted around its pivot point 72 such that the terminal or free end portion of the longer leg 72 will now be disengaged from the make/break contact portion 64R whereby the switch mechanism will now be disposed in a STANDBY state.

With reference again being made to FIGS. 1 and 3, it is seen that the wireform contact members 66R,66L further comprise vertically oriented portions 76R,76L which are integral with the first horizontally disposed terminal end contact portions 64R,64L, and second horizontally disposed terminal end connector portions 78R,78L. It is appreciated that the first horizontally disposed terminal end contact portions 64R,64L and the vertically oriented portions 76R, 76L of the wireform contact members 66R,66L are disposed within common vertical planes, and that the second horizontally disposed terminal end connector portions 78R,78L extend perpendicular to such common vertical planes. In addition, in order to effectively rigidly mount or secure the second horizontally disposed terminal end connector portions 78R,78L of the wireform contact members 66R,66L upon the upper power switch housing section 16, the latter is provided with a pair of laterally or transversely spaced resilient or flexible detent clamping members 80R,80L which have a substantially C-shaped cross-sectional configuration. The second horizontally disposed terminal end connector portions 78R,78L are therefore adapted to be effectively snap-fitted within such clamping members 80R, 80L whereby the wireform contact members 66R,66L have their opposite terminal end portions fixedly mounted upon the upper power switch housing section 16 by means of the clamping members 80R,80L and the coaxially aligned sets of apertures 60R,60L and 62R,62L.

It is lastly noted that the new and improved combination, one-piece, integral rocker-type power switch and electrical connector module 10, constructed in accordance with the principles and teachings of the present invention, is particularly adapted to be mounted upon a wall or similar panel member, and accordingly, the front wall 42 of the upper power switch housing section 16 is provided with an upstanding flanged portion 82, and a pair of laterally spaced flexibly resilient lugs or fingers 84,84 are spaced rearwardly from the flanged portion 82 by means of a predetermined distance so as to define a space or gap 86 therebetween. In a similar manner, the front wall 88 of the lower power switch housing section 18 is provided with a downwardly extending flanged portion 90, and a pair of fixed laterally spaced lugs 92,92 are spaced rearwardly from the flanged portion 90 by means of a predetermined distance so as to likewise define a gap or space 94 therebetween. In this manner, the new and improved combination, one-piece, integral rocker-type power switch and electrical connector module 10 of the present invention can be mounted upon a suitable wall or panel member by, for example, inserting the module 10 within an aperture, not shown, provided within the wall or panel member as a result of a lower aperture wall portion being disposed within space 94 while an upper aperture wall portion is fitted within space 86 after resilient deflection of the lug or finger members 84,84.

Thus, it may be seen that in accordance with the principles and teachings of the present invention, there has been provided a new and improved combination, one-piece, integral rocker-type power switch and electrical connector module 10 which is particularly adapted for mounting upon a wall or panel member, and wherein further, the new and improved combination, one-piece, integral rocker-type power switch and electrical connector module 10 comprises a power switch housing 12 having its rocker switch mechanism 48,58 mounted within an upper power switch housing section 16, while an electrical connector housing 14 is accommodated and integrally fixed within an axially extending throughbore defined within an enclosed or surrounding tubular lower power switch housing section 18. Wireform contacts 66R,66L are mounted within the upper power switch housing section 16 of the combination module 10 so as to electrically connect the rocker switch mechanism 48,58 to suitable electrical connector terminals or pins which are to be operatively disposed within the electrical connector housing 14 whereby power to such connector terminals or pins are controlled by means of the rocker switch mechanism 48,58 and wireform contacts 66R,66L.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A combination, electrical connector-power switch module, comprising:

an electrical connector housing for accommodating a plurality of electrical connector terminals for connection to electrical circuits; and a power switch housing comprising an upper power switch housing section and a lower power switch housing section integral with said upper power switch housing section;

said upper power switch housing section having a plurality of electrical contacts disposed therein for providing electrical power to the electrical connector terminals and electrical circuits operatively associated with said electrical connector housing, and a switch mechanism mounted within said upper power switch housing section for controlling electrical power from said plurality of contacts disposed within said upper power switch housing section to the electrical connector terminals of said electrical connector housing; and said lower power switch housing section comprising an enclosed tubular structure having a throughbore extending therethrough, from a rear surface portion of said lower power switch housing section to a front surface portion of said lower power switch housing section, within which said electrical connector housing is fixedly disposed.

2. The combination module as set forth in claim 1, wherein:

said electrical connector and power switch housings are fabricated from a suitable thermoplastic material; and said electrical connector housing is fixedly mounted within said tubular lower power switch housing section of said power switch housing by ultrasonic welding.

3. The combination module as set forth in claim 1, wherein:

said electrical connector housing is fixedly mounted within said tubular lower power switch housing section of said power switch housing by adhesive bonding.

4. The combination module as set forth in claim 1, wherein:

a rear portion of said electrical connector housing is provided with flanged members for abutting said rear surface portion of said lower power switch housing section so as to facilitate proper seating of said electrical connector housing within said throughbore defined within said tubular lower power switch housing section.

5. The combination module as set forth in claim 1, wherein:

said electrical connector housing comprises an array of cells within which the electrical connector terminals can be respectively disposed.

6. The combination module as set forth in claim 5, wherein:

said array of cells comprises two rows of cells with each row of cells comprising three cells.

7. The combination module as set forth in claim 1, wherein:

a first one of said plurality of electrical contacts disposed within said upper power switch housing section defines a common electrical contact, and a second one of said plurality of electrical contacts disposed within said upper power switch housing section defines a make/break electrical contact;

said switch mechanism comprises a contactor which has a first portion which is always disposed in contact with said common electrical contact, and a second portion which is movable between a first position at which said second portion is engaged with said make/break electrical contact so as to define an ON state for said power switch, and a second position at which said second portion is disengaged from said make/break electrical contact so as to define a STANDBY state for said power switch; and an actuator is disposed in contact with contactor for causing movement of said second portion of said contactor between said first and second positions.

8. The combination module as set forth in claim 7, wherein:

said contactor comprises a substantially U-shaped hairpin type contactor comprising first and second leg members.

9. The combination module as set forth in claim 8, wherein:

said first leg member of said contactor has said first portion of said contactor defined therein as a recessed portion disposed around said common electrical contact so as to define therewith a first pivotal axis around which said contactor is pivotally movable between said first and second positions; and said actuator comprises a rocker-type actuator pivotally movable around a second pivotal axis for movement between first and second positions and engaged with said second leg member of said contactor for movably actuating said contactor between said first and second positions of said contactor when said actuator is moved between said first and second positions of said actuator.

10. The combination module as set forth in claim 7, further comprising:

substantially C-shaped clamping members integrally formed upon said upper power switch housing section for clampingly engaging portions of said first and second common and make/break electrical contacts.

11. The combination module as set forth in claim 7, wherein:

said upper power switch housing section comprises a pair of oppositely disposed side walls having a pair of apertures defined within each one of said pair of oppositely disposed side walls wherein each one of said pair of apertures defined within one of said pair of oppositely disposed side walls is coaxially aligned with one of said pair of apertures defined within the other one of said pair of oppositely disposed side walls; and said common electrical contact and said make/break electrical contact extend transversely across said upper power switch housing section between said pair of oppositely disposed side walls wherein an end portion of said common electrical contact enters a first one of said apertures defined within a first one of said pair of oppositely disposed side walls and exits through a first one of said apertures, coaxially aligned with said first one of said apertures defined within said first one of said pair of oppositely disposed side walls, defined within a second one of said pair of oppositely disposed side walls, and an end portion of said make/break electrical contact enters a second one of said apertures defined within said first one of said pair of oppositely disposed side walls and exits through a second one of said apertures, coaxially aligned with said second one of said apertures defined within said first one of said pair of oppositely disposed side walls, defined within said second one of said pair of oppositely disposed side walls.

12. A combination, electrical connector-power switch module, comprising:

an electrical connector housing for accommodating a plurality of electrical connector terminals for connection to electrical circuits;

a power switch housing comprising an upper power switch housing section and a lower power switch housing section integral with said upper power switch housing section; and first means mounted upon said upper power switch housing section for enabling said combination module to be mounted upon a panel member, and second means mounted upon said lower power switch housing section for cooperating with said first means mounted upon said upper power switch housing section so as to enable said combination module to be mounted upon the panel member;

said upper power switch housing section having a plurality of electrical contacts disposed therein for providing electrical power to the electrical connector terminals and electrical circuits operatively associated with said electrical connector housing, and a switch mechanism mounted within said upper power switch housing section for controlling electrical power from said plurality of contacts disposed within said upper power switch housing section to the electrical connector terminals of said electrical connector housing; and said lower power switch housing section comprising an enclosed tubular structure having a throughbore extending therethrough, from a rear surface portion of said lower power switch housing section to a front surface portion of said lower power switch housing section, within which said electrical connector housing is fixedly disposed.

13. The combination module as set forth in claim 12, wherein:

said electrical connector and power switch housings are fabricated from a suitable thermoplastic material; and said electrical connector housing is fixedly mounted within said tubular lower power switch housing section of said power switch housing by ultrasonic welding.

14. The combination module as set forth in claim 12, wherein:

said electrical connector housing is fixedly mounted within said tubular lower power switch housing section of said power switch housing by adhesive bonding.

15. The combination module as set forth in claim 12, wherein:

a rear portion of said electrical connector housing is provided with flanged members for abutting said rear surface portion of said lower power switch housing section so as to facilitate proper seating of said electrical connector housing within said throughbore defined within said tubular lower power switch housing section.

16. The combination module as set forth in claim 12, wherein:

said electrical connector housing comprises an array of cells within which the electrical connector terminals can be respectively disposed.

17. The combination module as set forth in claim 16, wherein:

said array of cells comprises two rows of cells with each row of cells comprising three cells.

18. The combination module as set forth in claim 12, wherein:

a first one of said plurality of electrical contacts disposed within said upper power switch housing section defines a common electrical contact, and a second one of said plurality of electrical contacts disposed within said upper power switch housing section defines a make/break electrical contact;

said switch mechanism comprises a contactor which has a first portion which is always disposed in contact with said common electrical contact, and a second portion which is movable between a first position at which said second portion is engaged with said make/break electrical contact so as to define an ON state for said power switch, and a second position at which said second portion is disengaged from said make/break electrical contact so as to define a STANDBY state for said power switch; and an actuator is disposed in contact with contactor for causing movement of said second portion of said contact or between said first and second positions.

19. The combination module as set forth in claim 18, wherein:

said contactor comprises a substantially U-shaped hairpin type contactor comprising first and second leg members.

20. The combination module as set forth in claim 19, wherein:

said first leg member of said contactor has said first portion of said contactor defined therein as a recessed portion disposed around said common electrical contact so as to define therewith a first pivotal axis around which said contactor is pivotally movable between said first and second positions; and said actuator comprises a rocker-type actuator pivotally movable around a second pivotal axis for movement between first and second positions and engaged with said second leg member of said contactor for movably actuating said contactor between said first and second positions of said contactor when said actuator is moved between said first and second positions of said actuator.

21. The combination module as set forth in claim 18, further comprising:

substantially C-shaped clamping members integrally formed upon said upper power switch housing section for clampingly engaging portions of said first and second common and make/break electrical contacts.

22. The combination module as set forth in claim 18, wherein:

said upper power switch housing section comprises a pair of oppositely disposed side walls having a pair of apertures defined within each one of said pair of oppositely disposed side walls wherein each one of said pair of apertures defined within one of said pair of oppositely disposed side walls is coaxially aligned with one of said pair of apertures defined within the other one of said pair of oppositely disposed side walls; and said common electrical contact and said make/break electrical contact extend transversely across said upper power switch housing section between said pair of oppositely disposed side walls wherein an end portion of said common electrical contact enters a first one of said apertures defined within a first one of said pair of oppositely disposed side walls and exits through a first one of said apertures, coaxially aligned with said first one of said apertures defined within said first one of said pair of oppositely disposed side walls, defined within a second one of said pair of oppositely disposed side walls, and an end portion of said make/break electrical contact enters a second one of said apertures defined within said first one of said pair of oppositely disposed side walls and exits through a second one of said apertures, coaxially aligned with said second one of said apertures defined within said first one of said pair of oppositely disposed side walls, defined within said second one of said pair of oppositely disposed side walls.

* * * * *